US010030409B2

(12) United States Patent
Rodenburg

(10) Patent No.: US 10,030,409 B2
(45) Date of Patent: Jul. 24, 2018

(54) FENCE AND METHOD OF INSTALLING A FENCE

(71) Applicant: BETAFENCE HOLDING NV, Ghent (BE)

(72) Inventor: Michael Rodenburg, Stellenbosch (ZA)

(73) Assignee: PRAESIDIAD, Ghent (BE)

( * ) Notice: Subject to any disclaimer, the term of this patent is extended or adjusted under 35 U.S.C. 154(b) by 313 days.

(21) Appl. No.: 14/765,718

(22) PCT Filed: Jan. 14, 2014

(86) PCT No.: PCT/IB2014/058262

§ 371 (c)(1),
(2) Date: Aug. 4, 2015

(87) PCT Pub. No.: WO2014/122540

PCT Pub. Date: Aug. 14, 2014

(65) Prior Publication Data

US 2015/0368927 A1 Dec. 24, 2015

(30) Foreign Application Priority Data

Feb. 5, 2013 (BE) ..... 2013/0075

(51) Int. Cl.

| | |
|---|---|
| ***E04H 17/16*** | (2006.01) |
| ***E04H 17/22*** | (2006.01) |
| ***E02D 29/02*** | (2006.01) |

(52) U.S. Cl.

CPC ..... *E04H 17/161* (2013.01); *E02D 29/0208* (2013.01); *E02D 29/0216* (2013.01); *E02D 29/0241* (2013.01); *E04H 17/16* (2013.01); *E04H 17/22* (2013.01)

(58) Field of Classification Search

CPC ..... E02D 29/0208; E02D 29/0216; E02D 29/0241; E02D 29/0291; E04H 17/16; E04H 17/161; E04H 17/163; E04H 17/18; E04H 17/22

USPC ..... 256/24, 26, 32, 33, 73

See application file for complete search history.

(56) References Cited

U.S. PATENT DOCUMENTS

| | | | | |
|---|---|---|---|---|
| 7,670,082 | B2 * | 3/2010 | Olsta | E02D 29/0208 405/129.75 |
| 8,206,065 | B2 * | 6/2012 | Heselden | E02D 29/0208 405/15 |
| 2010/0186642 | A1 * | 7/2010 | Christman | E02D 29/0208 109/79 |

FOREIGN PATENT DOCUMENTS

| | | | | |
|---|---|---|---|---|
| CN | 201310092 | Y | 9/2009 | |
| DE | 102005016733 | A1 * | 10/2006 | E02D 29/0208 |
| EP | 0069473 | A1 | 1/1983 | |
| EP | 2136001 | A1 | 12/2009 | |

(Continued)

OTHER PUBLICATIONS

International Search Report dated Jul. 18, 2014.

*Primary Examiner* — Josh Skroupa

(74) *Attorney, Agent, or Firm* — Symbus Law Group, LLC; Clifford D. Hyra

(57) ABSTRACT

A fence (1) and a method of installing a fence (1) in which the fence (1) has front panels (2), bottom panels (3) and side panels (4), in which the method comprises the burying of the bottom panels (3) such that the bottom panels (3) are located underground and such that part of the front panels (2) and side panels (4) are located underground. The front panels (2) of the installed fence (1) further extend in the same plane and the side panels (4) work as wind bracing.

26 Claims, 8 Drawing Sheets

(56) References Cited

FOREIGN PATENT DOCUMENTS

| | | | | | |
|---|---|---|---|---|---|
| GB | 845863 | A | * | 8/1960 | ..... E02D 29/0208 |
| JP | 2001245546 | A | | 9/2001 | |
| NL | 8700470 | A | | 9/1988 | |

* cited by examiner

FENCE AND METHOD OF INSTALLING A FENCE

This application claims the benefit of Belgian patent application No. BE2013/0075, filed Feb. 5, 2013, which is hereby incorporated by reference in its entirety.

FIELD OF THE INVENTION

The present invention relates to a fence and a method of installing a fence in which the fence comprises front mesh panels and;

bottom mesh panels;

where in installed state of the fence the front panels are connected at an angle with the bottom panels, in which the method comprises the placing of the fence on the ground, such that the bottom panels are located on the bottom and in which the method comprises the burying of the bottom panels such that the bottom panels are located underground and such that part of the front panels is located underground.

BACKGROUND

Fences are used to prevent people, animals etc. to intrude a certain area. Many countries have one or several fences to protect their national borders as such to prevent people from other countries to immigrate. Also industrial sites, nature reserves or other areas/grounds are surrounded with the aid of fences to prevent intrusion of people and animals. These fences need to be solid, strong, firmly anchored in the ground and they should be difficult to climb and difficult to dig under in order to effectively stop potential intruders.

The mesh panels which are used in such fences usually comprise a first set of wires extending substantially parallel to one another and a second set of wires extending substantially parallel to one another, wherein the wires from the first set and the second set intersect, and where these intersect are mutually attached.

With the term 'wires' elongate elements or rod-shaped elements are indicated. These wires are, for example, formed by pulling force or by extrusion and they can be made out of metal, plastic, etc. The wires can for example be welded together where they intersect in order to attach the wires. Welding indicates every operation or treatment, whether or not with the addition of welding materials or gluing materials or products and whether or not accompanied by a (local) heating of the parts to be connected, which creates a durable connection without external coupling means and with a substantially mechanical connecting function. The mesh panels of this fence can also be produced by making holes in solid panels and by stretching these panels as such to create a wire-shaped pattern.

Many fences use posts to firmly anchor the fence in the ground. JP 2001245546 describes a fence with front panels and bottom panels in which the bottom panels are buried. Because of this the bottom panels and part of the front panels are located underground and people or animals cannot easily dig under the fence. To ensure the strength, firmness and rigidity of the fence, the fence further comprises posts to anchor the fence firmly in the ground.

The necessity of posts to ensure the strength of a fence is seen as a disadvantage. For every post a separate hole needs to be drilled and each post needs to be embedded in concrete to obtain a solid and rigid fence. The placing of a fence with posts is therefore labor-intensive and requires an additional substance, namely concrete. Fences which are used to shield national borders, nature reserves and industrial sites are often several kilometers long. They are also often located in areas which are difficult to reach and are remote. To get everything in place, good organization and lots of time are required. Therefore the less materials needed, the better. The need for concrete contributes to the need for additional time and organization because it is not always possible to make concrete on site and concrete has a limited drying period. For example, on certain sites the necessary requirements to make concrete, like water, electricity, etc. are not available on site. So concrete has to be delivered on site. But if the site is a remote site or a site located in a hot and/or dry area, the delivery of concrete is, because of its limited drying time, problematic.

In sandy areas the use of posts has also another problem. The digging of holes to put in the posts is difficult because the holes easily collapse. Often holes need to be re-dug several times. This is of course time consuming.

EP 0069473 describes a fence where the use of posts, which are anchored in the ground, is no longer necessary. The fence comprises front panels and bottom panels in which the bottom panels are buried. In installed state of the fence the bottom panels are located underground and the front panels are arranged in a zigzag configuration and are partly located underground. Because part of the fence is located underground and because of the zigzag configuration of the front panels, the fence has a certain strength and firmness. However the strength is limited and the fence is easy to climb precisely because of the zigzag configuration of the front panels. The ability to keep intruders out is therefore limited.

The object of the invention is therefore to provide a fence which does not comprise posts that need to be anchored in the ground, which does not require concrete, which is strong and firm and which is effective against intruders. The object of the invention is also to provide in a method of installing such fence in which the installation is less labor-intensive, less time consuming and which does not require additional substances such as concrete.

SUMMARY

The object of the invention is achieved by providing a method of installing a fence in which the fence comprises front mesh panels and bottom mesh panels, where in installed state of the fence the front panels are connected at an angle with the bottom panels, in which the method comprises the placing of the fence on the ground, such that the bottom panels are located on the bottom and in which the method comprises the burying of the bottom panels such that the bottom panels are located underground and such that part of the front panels is located underground, wherein in installed state of the fence the front panels extend substantially in the same plane, wherein the fence comprises side panels which are, in installed state of the fence, connected at an angle with the front panels and are connected at an angle with the bottom panels and wherein after the burying of the bottom panels, part of the side panels are located underground.

With 'panels connected at an angle' it is indicated that the panels do not extend in the same plane. With 'the front panels extend substantially in the same plane' it is indicated that the front panels are aligned and form substantially one surface.

With this fence no posts are needed to get a strong and firm fence. The fence is firm because part of the fence is located underground and also due to the side panels. The side panels which are connected at an angle to the front panels and to the bottom panels ensure that forces acting upon the fence can easily be withstand. The side panels work as wind bracing. Forces acting upon the front panels are guided trough the side panels.

Because of the lack of posts, no concrete is needed to embed the posts and no holes need to be dug for the posts. This method therefore takes less time, is less labor-intensive and involves less organizational and logistic problems than the installation of fences with posts. Certainly for remote places, sandy places, and/or dry places such as deserts this method is very convenient.

The parts of the front panels and side panels which are erected aboveground are the parts of the fence that are visible. In normal circumstances the fence is placed so that the front side of the fence, being the front panels behind which the side panels and bottom panels are located in installed state of the fence, is situated on the side where the intruders must be stopped. As a result the side panels are not available to climb the fence which makes it difficult to climb the fence. The bottom panels prevent the digging of holes under the fence.

It is possible to look trough mesh panels. When monitoring a border or a protected area it is desired that one can see what is happening on the other side of the fence. With a fence comprising mesh panels, one can easily look through the fence to see what is happening. When it is not desired that people can look through the fence, the mesh panels can easily be blinded.

In a preferred embodiment of the invention the method comprises, prior to the placing of the fence, the making of a ditch, and during the placing of the fence, the fence is placed in this ditch and, in order to bury the bottom panels, the ditch is refilled. Because the fence is located in the ditch and this ditch is refilled, the fence is strongly anchored in the ditch, therefore strongly anchored in the ground. The ground, that is excavated during the making of the ditch, can simply be used to refill the ditch. It is therefore possible to use just the ground that is present at the site where the fence is placed. Also the initial ground level needs not to be altered for this specific embodiment. The digging of one ditch is simple, even in sandy areas, because one could make sure that the ditch is wide enough so that partly collapsing of the excavated ditch is no problem. The ditch can for example be excavated by an excavator or a bulldozer. Additionally it is more difficult to dig under the fence when the bottom panel is located below the initial ground level.

Preferably the fence comprises rear panels which are, in installed state of the fence, connected with the bottom panels at an angle and are connected with the side panels at an angle, wherein in installed state of the fence, the fence comprises containers, confined by the bottom panels, the front panels, the side panels and the rear panels, in which during the burying of the bottom panels, the containers are filled such that they are substantially located underground. With 'the containers being substantially located underground' is meant that the bottom panel is located underground, and that also at least a part of the front panels, the side panels and the rear panels are located underground. The rear panels provide additional strength to the fence. This is because they form, together with the other panels, containers which have a certain strength and rigidity. The burying of the bottom panels of the fence is also easier, one simply has to fill the containers. Preferably the rear panels are located completely underground. As a result of this the rear panels are no longer visible and do not form an obstacle. Preferably the front panels and side panels are only located partly underground so that the front panels form barriers and the side panels can provide enough strength to the fence. When you have a fence where the rear panels are completely located underground in installed state of the fence, you have a fence where the height of the rear panels in installed state of the fence is less than the height of the front panels, so you have a fence where the containers are easily accessible during the burying of the bottom panels.

In a preferred embodiment the front panels are connected at an angle of substantially 90° with the side panels, the front panels are connected at an angle of substantially 90° with the bottom panels, and the side panels are connected at an angle of substantially 90° with the bottom panels. This means that, in installed state of the fence, the angles between the front panels and the side panels, the angles between the front panels and the bottom panels, and the angles between the side panels and the bottom panels are substantially 90°. With these angles of substantially 90° a strong and firm fence is obtained that can withstand the forces that act upon it.

Further preferably, if rear panels are present, the bottom panels are connected at an angle of substantially 90° with the rear panels and the rear panels are connected at an angle of substantially 90° with the side panels. This means that the containers have a cuboid shape and a rectangularly shaped cross section. Such cuboid shaped containers are very rigid and firm and provide the fence with considerable additional strength and rigidity.

Of course other embodiments where for example the angles between the front panels and side panels and between the side panels and bottom panels are not 90° are also possible.

The fence preferably comprises at least two states, an installed state and a more compact state suitable for transport and storage, wherein the fence is delivered on site in its compact state and wherein the fence is at least partially transformed from its compact state to its installed state before placing the fence on the ground. As such transport and storage can be more efficient and simple because for transport and storage the fence can be in its compact state.

Further preferably the fence comprises in its compact state several separate units which are connected to each other during the transformation from its compact state to its installed state. By making use of several separate units the fence can be made very compact. With several more or less standardized units it is also simple to obtain fences of different lengths.

Still further preferably, when the fence comprises rear panels, each said separate unit comprises at least one front panel, at least two side panels, at least one bottom panel and at least one rear panel wherein the side panels are pivotally connected to the front panel;

the bottom panel is pivotally connected to the front panel;

the rear panel is pivotally connected to the bottom panel;

wherein the dimensions of the bottom panel, the side panels and the rear panel extend within the dimensions of the front panel, wherein in the compact state of the fence each separate unit is folded up and wherein during the transformation of the fence from its compact state to its installed state, each unit is unfolded, the bottom panel is connected at an angle to the side panels, the rear panel is connected to the side panel at an angle and the units are connected to each other.

Pivotal connections ensure that the panels can be easily folded and unfolded. It is logical that, in the compact state of the fence, the side panels are not connected to the bottom panels and that the rear panels are not connected to the side panels. This in order to make sure that the compact state occupies as little space as possible. The compactness is also a result of the dimensions of the bottom panel, the side panels and the rear panel. The said dimensions extend within the dimensions of the front panel. The pivotal connections are preferably located at the edges of the side panels. This is a simple connection and such connection contributes to the compactness of the compact state. These pivotal connections are preferably spiral connections/helical wire members or coils. Also the connections that are made during the transformation of the fence from its compact state to its installed state are preferably spiral connections/helical wire members. Instead of spiral connections between the panels also clips, hinges or other connections are possible.

To get a firm fence the height of the side panels is preferably substantially the same as the height of the front panels. The fence is then very firm because the front panels are supported by the side panels over their entire length.

Also preferably in the compact state of the fence, each separate unit is folded up such that the side panels are located between the front panel on the one hand and between the bottom panel and the rear panel on the other hand such that during the unfolding of the units, the bottom panel is pivoted before pivoting a said side panel.

The dimensions of the bottom panel and the rear panel are preferably within the dimension of the front panel. The bottom panel and the rear panel extend preferably substantially in the same plane and they extend preferably substantially parallel relative to the front panel and the side panels. The size of the front panel then determines the soil surface of each separate unit in its compact state.

In a very preferred embodiment of the method, where the embodiment is a method for installing a fence with rear panels, the fence comprises top panels which in installed state of the fence delimit the containers, and the top panels are placed on top of the containers after the containers are filled up. These top panels contribute to the rigidity of the fence. They are preferably connected to the rear panels, the side panels and the front panels to ensure the best rigidity of the fence.

These top panels are further preferably buried during the burying of the bottom panels. In installed state of the fence the top panels are then not visible.

Further, if the fence also comprises separate units, each said separate unit preferably comprises two top panels which are pivotally connected to the bottom panel, wherein in the compact state of the fence each separate unit is folded up such that the side panels are located between the front panel on the one hand and between the bottom panel, the rear panel and the top panels on the other hand and wherein during the transformation of the fence from its compact state to its installed state each top panel is connected to the front panel and to the side panels. The dimensions of the bottom panel, the rear panel and the top panels preferably are within the dimension of the front panel. The bottom panel, the rear panel and the top panels preferably extend substantially in the same plane and they preferably extend substantially parallel relative to the front panel and the side panels, such that the compact state does not occupy a lot of space.

In a preferred embodiment adjacent panels are connected to each other with the aid of hooks. These hooks provide additional rigidity to the fence, making it stronger and more firm. A hook can for example connect the rear sides of two side panels which are connected to the same front panel or are connected to two front panels which are directly connected to each other. A hook can also for example connect the rear side of a side panel with the center of the front side of the front panel to which the side panel is directly connected. There can also be a combination of different hook connections. These 'hooks' are elements that can hook into two adjacent panels as such to connect them. Such a hook can for example be a wire shaped element that is bent at both ends such that every end can hook into the meshes of the panels to be connected. This wire shaped element can for example have a circular cross section or a rod shaped cross section.

The object of the invention is also achieved by providing a fence comprising front mesh panels and;

bottom mesh panels;

where in installed state of the fence the bottom panels are connected at an angle with the front panels and the bottom panels and part of the front panels are located underground, wherein in installed state of the fence the front panels extend substantially in the same plane, wherein the fence comprises side panels which, in installed state of the fence, are connected at an angle with the front panels, are connected at an angle with the bottom panels and are partly located underground and in which at least the part of the front panels and side panels which are substantially located aboveground comprise a first set of wires extending substantially parallel to one another;

a second set of wires extending substantially parallel to one another, wherein the wires from the first set and the second set intersect, and where these intersect are mutually welded, and wherein a part of the first set of wires is arranged on the other side of the wires of the second set from the rest of the wires of the first set, and with this fence each of the wires of the part of the first set which are arranged on the other side of the second set, viewed in the longitudinal direction of the wires of the second set, are arranged at a certain spacing from the rest of the wires of the first set.

As already indicated in the description of methods according the invention, this fence is firm because in the installed state of the fence, part of the fence is located underground and the side panels work as wind bracing. The specific configuration of the wires, of at least the part of the panels which are substantially located aboveground, also contributes to the strength en rigidity of the fence. With such configuration a stronger panel is obtained with regard to panels where the first set of wires is only arranged on one site of the second set of wires. When using the configuration of the wires according to the invention, stronger panels are obtained, with the same amount of material. Since the wires of the front panels are partially located on the rear side of the fence it is more difficult with ordinary hand tools to cut through or break, from the front side of the fence, the wires which are located on the rear side. So this fence is difficult to penetrate.

In a preferred embodiment, the wires of the first set are arranged, in a systematic way, alternately on both sides of the second set of wires. By systematically providing wires from the first set alternately on one side and on the other side of the wires from the second set a stronger fence is obtained.

The wires from the first set, viewed in the longitudinal direction of the wires from the second set, are preferably arranged at a mutual spacing of between 10 and 15 mm. With such a small spacing a strong en rigid panel is obtained. Also such panel is difficult to climb, making it more difficult for intruders to climb over the fence.

In a particular preferred embodiment the fence comprises rear panels and in installed state of the fence, the rear panels are connected to the bottom panels and to the side panels such that the fence comprises containers which are delimited by the front panels, the side panels, the bottom panels and the rear panels. As indicated in the description of methods according the invention, fences with rear panels and therefore containers are more rigid and are stronger.

Preferably the side panels have a pentagonal shape in which the part of the side panel, which is substantially located aboveground in installed state of the fence, has a right-angled triangular shape and in which the other part of the side panel, which is substantially located underground in installed state of the fence, has a rectangular shape. In installed state of the fence, the dimension of the side panel, in the direction of the connection between the side panel and the bottom panel respectively the front panel, is at the level of said connection preferably substantially equal to the dimension of the bottom panel respectively the front panel in that direction. However the dimension of the side panel in the direction of the connection between the side panel and the bottom panel, at an aboveground level, may be less. A fence with side panels with a right-angled triangular shape aboveground is just as capable of withstanding forces as a fence with side panels with a rectangular shape aboveground, with the same dimensions as the dimensions of the straight sides of the right angled triangle. This means that it is better to use a side panel with a right-angled triangular shape aboveground, because this provides equal strength with less material. A right-angled triangular shape is also easy to produce. The shape of the side panels which are located underground in installed state of the fence have a rectangular shape so, that in combination with the rear panels, the front panels, and the bottom panels, containers are formed.

In an alternative embodiment the side panels have a stair shape.

In a specific embodiment the part of the front panels and the part of the side panels, which are substantially located underground in installed state of the fence, comprise a first set of wires extending substantially parallel to one another and a second set of wires extending substantially parallel to one another, wherein the wires from the first set and the second set intersect, and where these intersect are mutually welded, and wherein the first set of wires are arranged on one side of the wires of the second set. Also preferably the bottom panels and the possible rear panels have the above-mentioned configuration.

The part of the fence which is located underground in installed state of the fence needs not to be as strong and firm as the part of the fence which is located aboveground in installed state of the fence. The strength of the fence is partly determined by the configuration of the wires of the mesh panels and the mesh size. The larger the mesh size, the weaker the fence. If a panel is partly located underground and partly located aboveground, in installed state of the fence, this panel could have two different configurations of wires with different strengths. The part of the panel which is meant to be located underground can have a weaker configuration of wires than the part that is meant to be located aboveground. Also panels which are meant to be located completely underground in installed state of the fence, such as the bottom panels, can have a weaker configuration of wires. Panels with a weaker configuration of wires are less expensive and are easier to produce. Panels with larger mesh sizes or panels which partly have a lager mesh size require less material and or therefore less expensive.

In a very preferred embodiment the side panels are connected by their edges to the other said panels and the unconnected edge of the side panel is reinforced with a profile. This profile causes the side panel to be less prone to inclination when forces are acting upon the fence. The profile thus reinforces the side panels, and by this the fence, so that forces acting upon the fence can be better withstood.

Further preferably this profile is a U-shaped profile (14) as shown diagrammatically in FIGS. 11A and 11B. This is a simple form which can be easily manufactured. Also with U-shaped profiles the best results were obtained. Also H-shaped profiles give good results but they comprise more material than a U-shaped profile that provides the same additional strength to the fence.

In a preferred embodiment, where the fence comprises rear panels and containers, each container comprises a bag. During the placing of the fence the bottom panels should be buried, meaning that the containers should be filled. It is easier to fill the container if it comprises a bag. Witch this bag, ground or material put into the bag cannot leave the container.

Further preferably the bag is made of a water-permeable material such as for example geotextile, coconut coir, perforated plastic or perforated metal. The bag should let trough water but should not let trough the ground that is used to place the fence partly underground. This is especially important if the fence is placed in a sandy area and the fence is partly located in the sand. Sand is a material that can simply be transported by wind. Because of this the fence which is partly located underground, may, after a certain period of time, become exposed. Of course this is not the intention. Because of these bags, this can be avoided. Because of the water permeability the occurrence of water logging is avoided.

In a very preferred embodiment of the method of installing a fence, the method of installing a fence is a method for installing a fence as mentioned above.

BRIEF DESCRIPTION OF THE DRAWINGS

The present invention is now explained in greater detail below with reference to the following detailed description of some preferred embodiments of a fence and a method of installing a fence according to the present invention. The aim of this description is solely to give illustrative examples and indicate further advantages and particularities of this fence panel and this method and thus cannot be interpreted as a limitation of the field of application of the invention or of the patent rights claimed in the claims.

In this detailed description, reference is made by means of reference numerals to the appended drawings, wherein

FIG. 8 shows a simplified perspective view of the fence as shown in FIG. 7 during the refilling of the ditch;

DETAILED DESCRIPTION OF EMBODIMENTS

Figure 1:
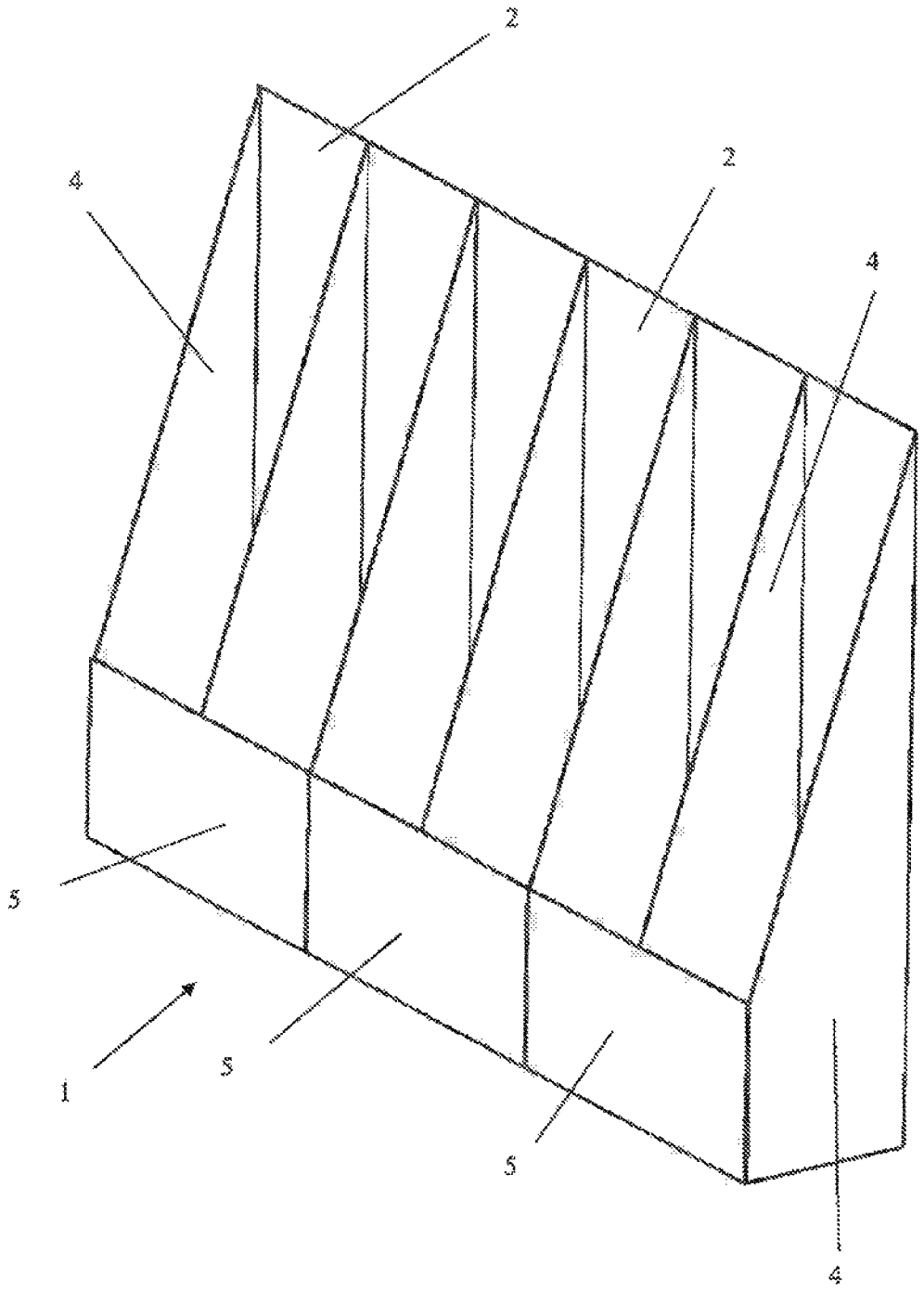
FIG. 1 shows a simplified representation of a perspective view of an embodiment of a fence according the invention.
Figure 2:
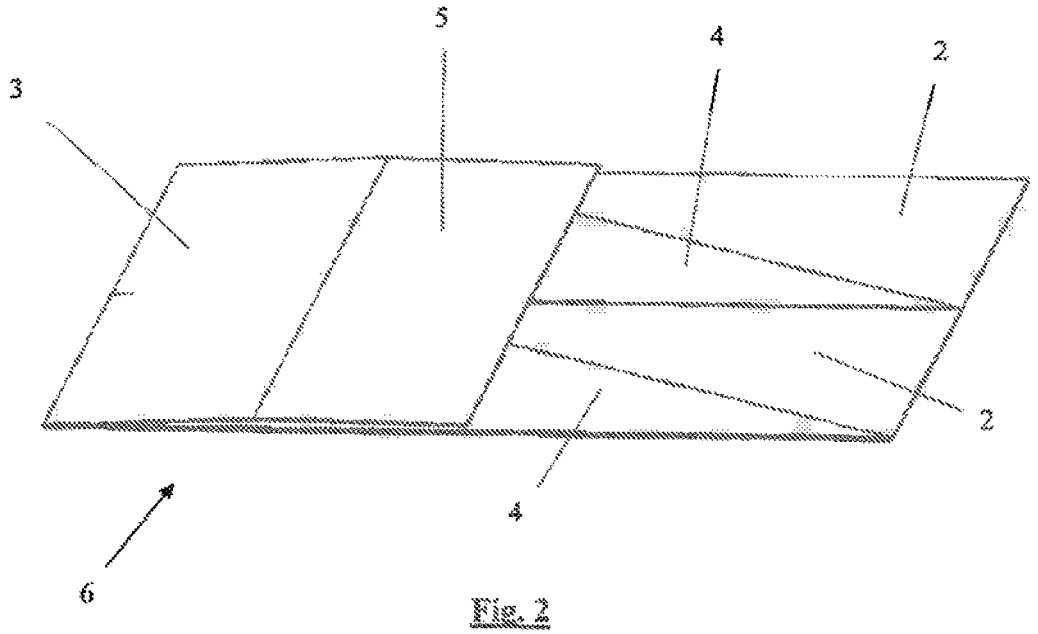
FIG. 2 shows a simplified representation of a perspective view of a folded unit.
Figure 3:
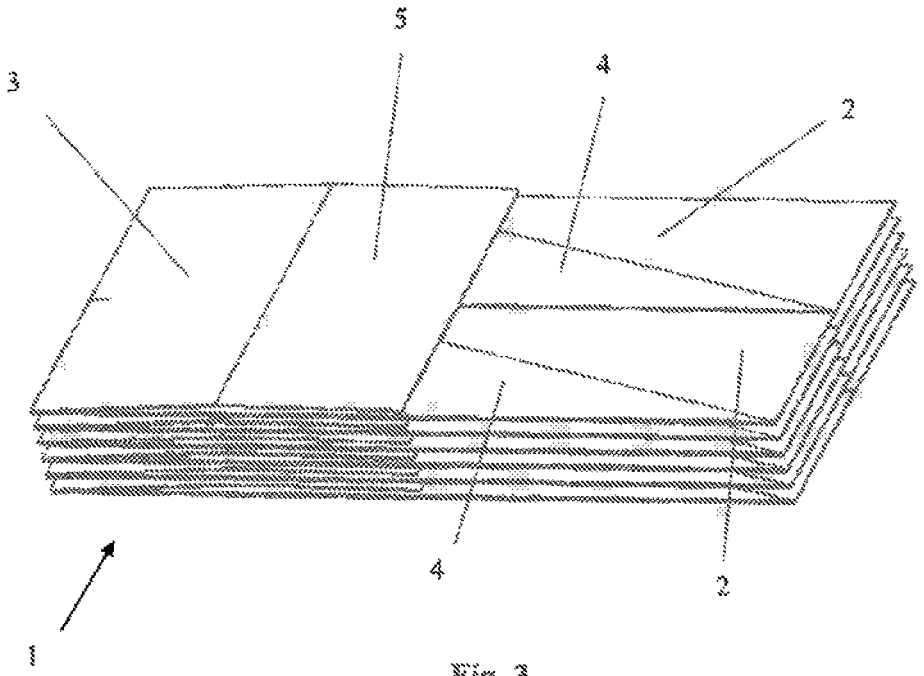
FIG. 3 shows a simplified presentation of a perspective view of several folded units stacked on top of each other.
Figure 4:
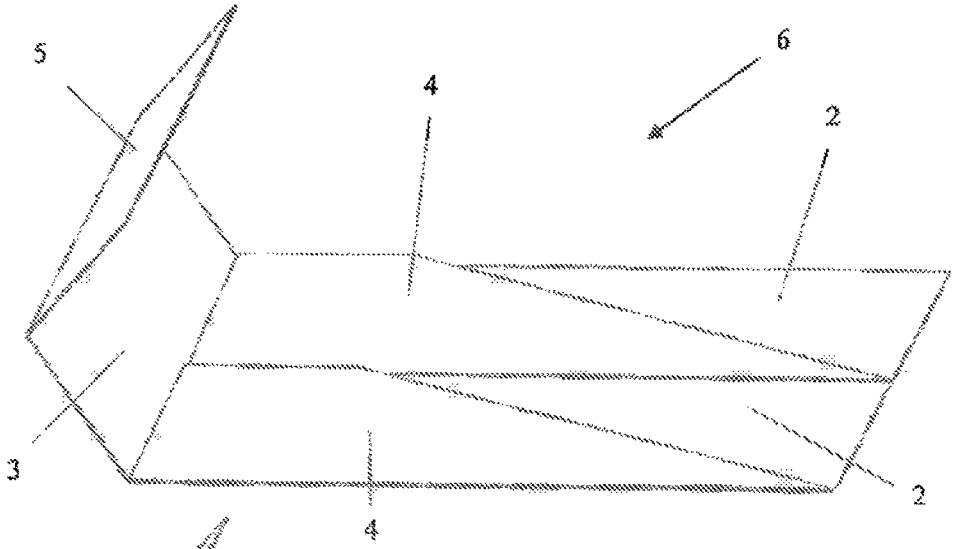
FIGS. 4, 5 and 6 show simplified perspective views of the unit as shown in FIG. 2 during the unfolding of the unit.
Figure 5:
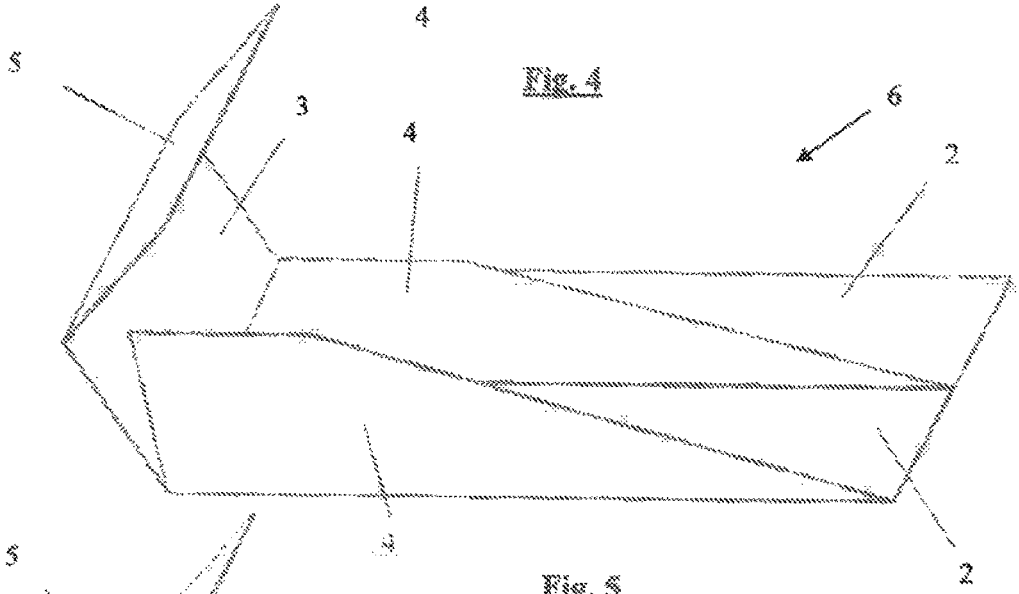
Figure 6:
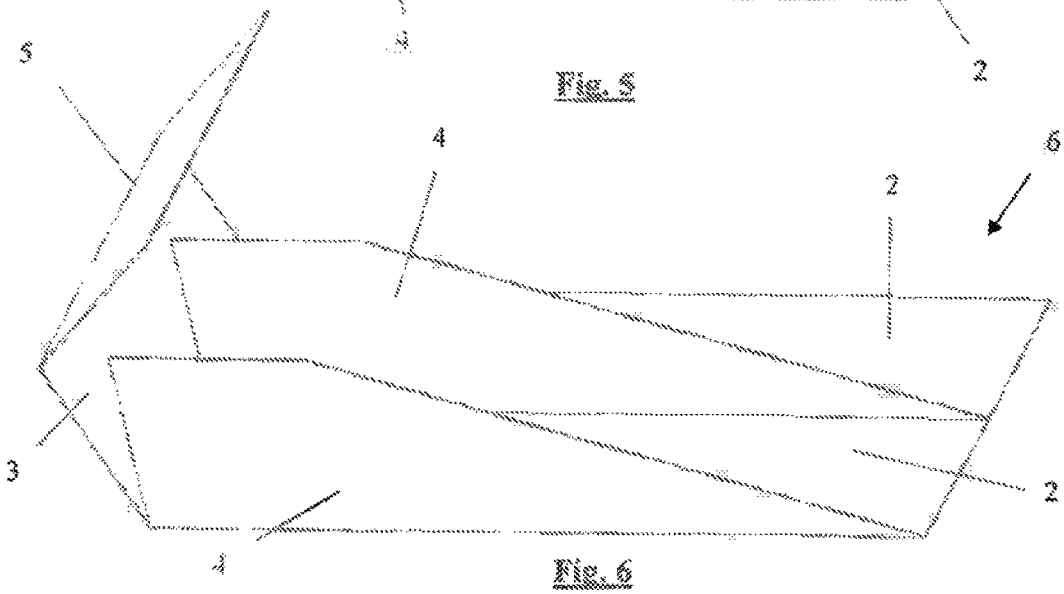
Figure 7:
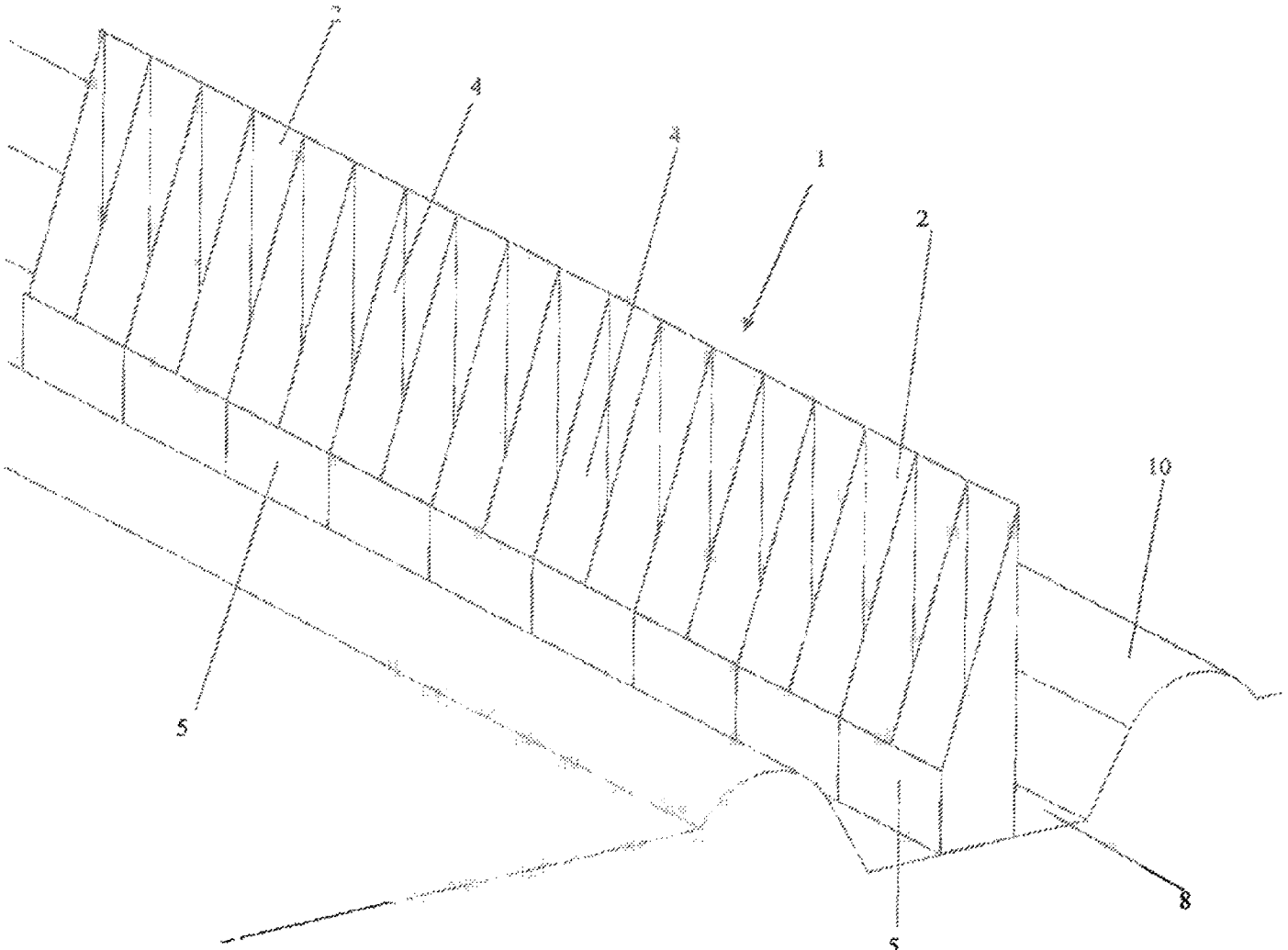
FIG. 7 shows a simplified perspective view of a fence which is placed in a ditch.
Figure 3:
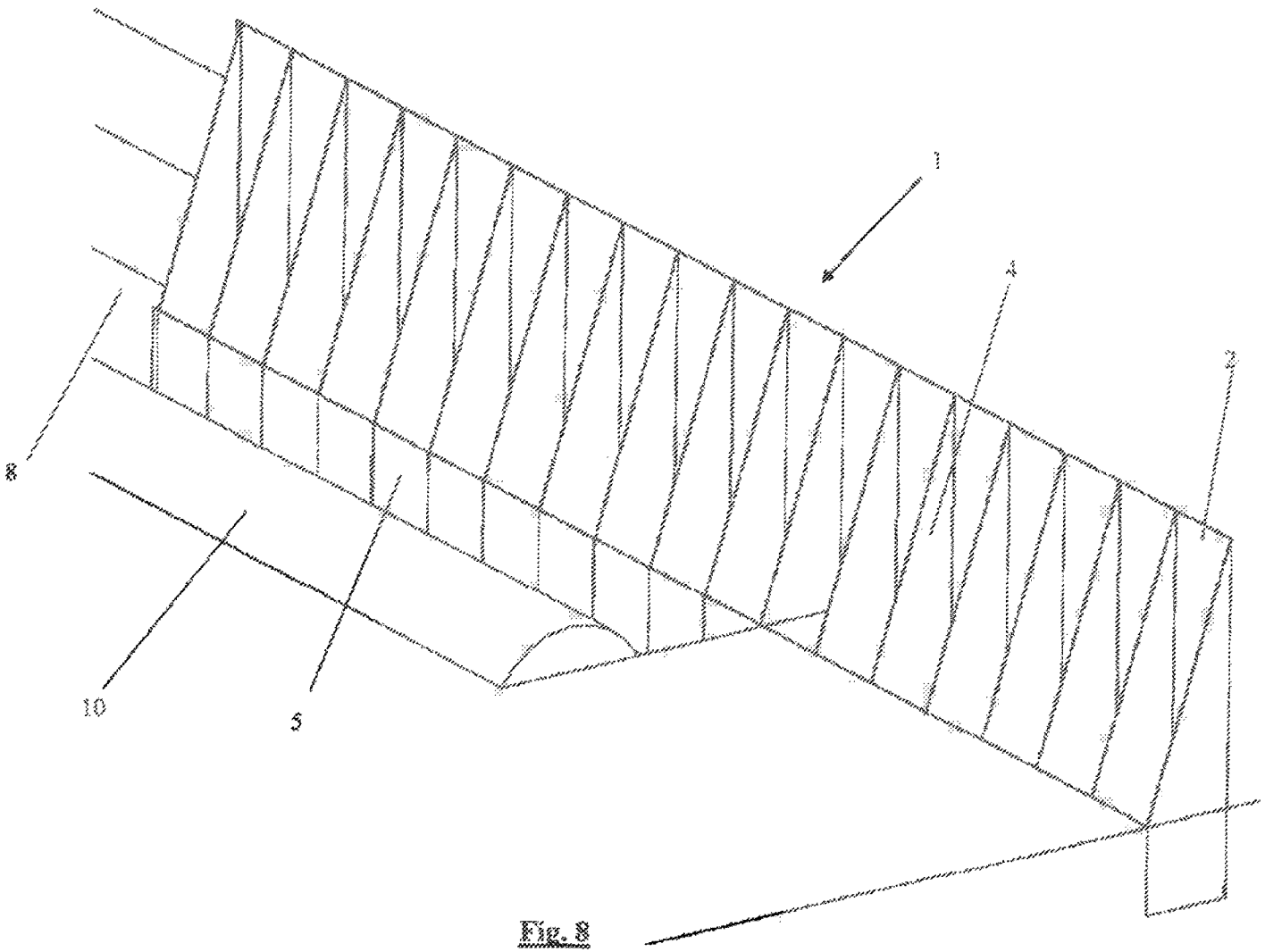

The fence (1), as viewed in FIGS. 1 to 8, is a first embodiment of a fence (1) according to the invention which comprises front panels (2), bottom panels (3), rear panels (5) and side panels (4). All these panels (2, 3, 4, 5) are mesh panels. The FIGS. 1 to 8 are simplified representations were every panel (2, 3, 4, 5) is represented as a white surface. The meshes would make the figures unclear. Also not all panels (2, 3, 4, 5) are indicated with their number for clarity reasons.

Figure 9:
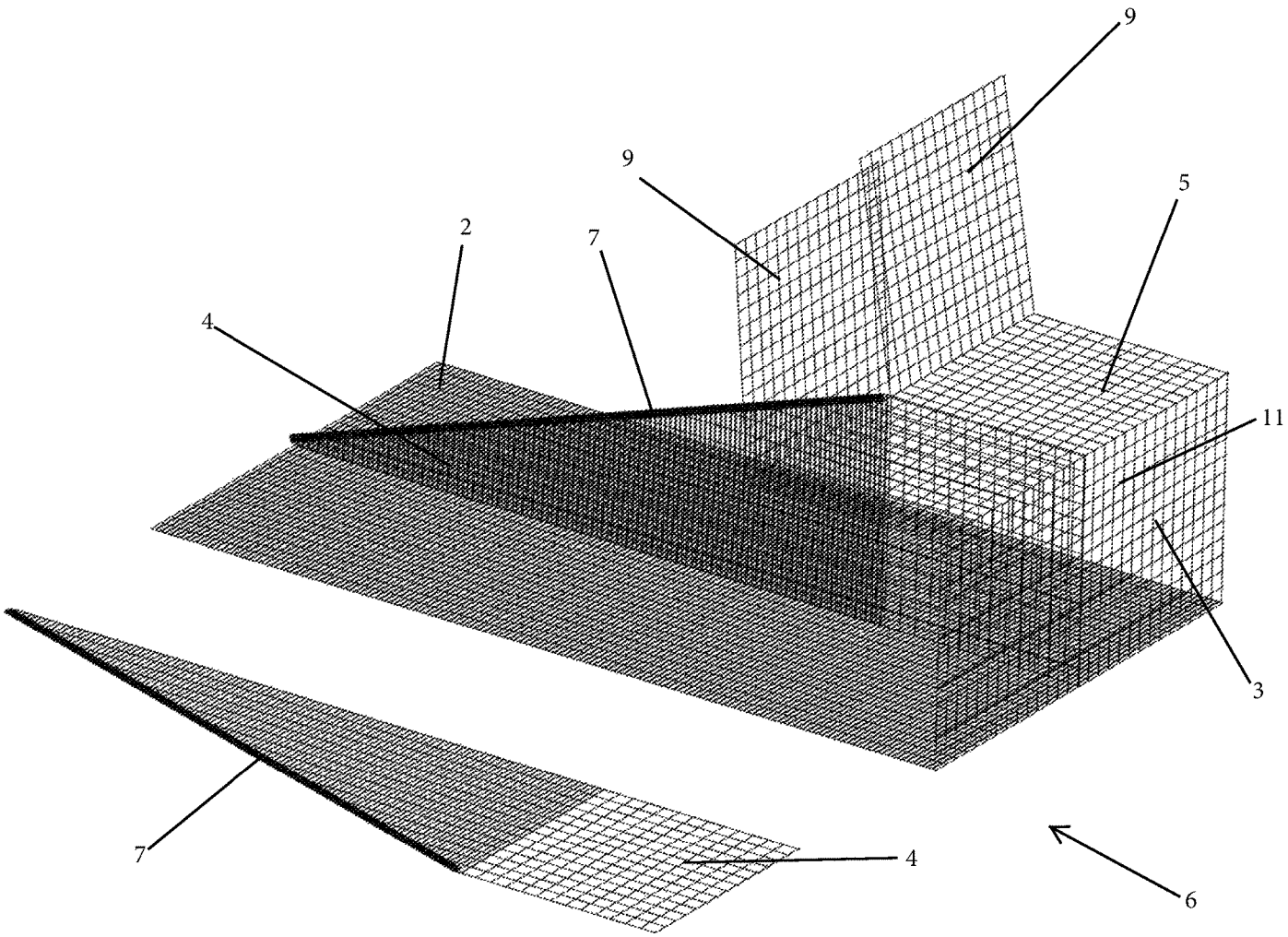
FIG. 9 shows a detailed representation of a unit of an embodiment of a fence according to the invention, wherein a side panel has been detached.
Figure 10:
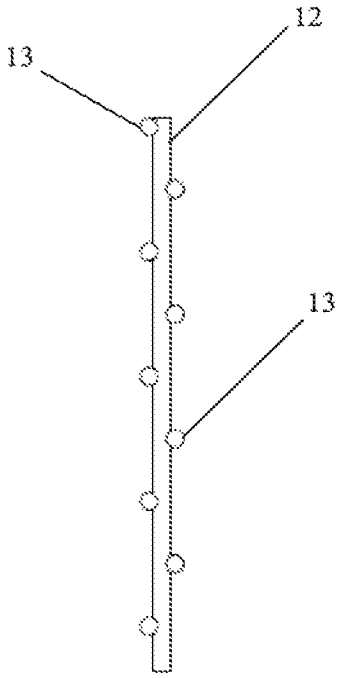
FIG. 10 shows a diagram of wires of the front and side panels.

FIG. 9 shows a more detailed representation of a unit (6) according to a second embodiment of a fence (1) according to the invention. In this unit (6) the meshes can be seen. Every unit (6) of this second embodiment has next to a front panel (2), bottom panel (3), two side panels (4) and a rear panel (5) also two top panels (9). Here one side panel (4) has been detached from the front panel (2).

Of course other embodiments are also possible.

The following is a detailed description of the first embodiment of a fence (1). However all this also applies to the second embodiment of the fence (1). All front panels (2) have the same dimensions, all bottom panels (3) have the same dimensions, all rear panels (5) have the same dimensions, also all side panels (4) have the same dimensions. The front panels (2) have a rectangular shape, the bottom panels (3) have a rectangular shape, the rear panels (5) also have a rectangular shape and the side panels (4) have a pentagonal shape, namely a square shaped part plus a right-angled triangular shaped part. The rear panels (5) and bottom panels (3) have the same dimensions.

The front panels (2) comprise a first set of wires extending substantially parallel to one another and comprises a second set of wires extending substantially parallel to one another, wherein the first set and the second set intersect under an angle of 90°, and where these intersect are mutually welded. The wires of the first set of wires (13) are arranged, in a systematic way, alternately on both sides of the second set of wires (12). The second set of the wires extend, in the installed state of the fence (1), vertically and the first set of wires extend, in installed state of the fence (1), horizontally. Of course these wires could also extend in other directions for example they could form a diagonally gridded mesh. The wires from the first set, viewed in the longitudinal direction of the wires from the second set, are arranged at a mutual spacing of between 10 and 15 mm and the wires of the second set, viewed in the longitudinal direction of the wires from the first set, are arranged at a mutual spacing of between 60 and 140 mm, preferably between 80 and 120 mm. The wires have a round cross section and they have a diameter between 2 and 8 mm, preferably between 3 and 5 mm. The wires are made out of steel. However also wires with other cross sections, for example wires with a rectangular cross section are possible. Also the wires can be made out of a different metal or out of plastic. The abovementioned configuration of the wires provides a very strong panel (1) that has also a certain resistance to bullets. The right-angled triangular shaped parts of the side panels (4) also have the same configuration of wires mentioned above.

The wires of the square shaped parts of the side panels (4) have a different configuration. In this different configuration the wires comprise a first set of wires extending substantially parallel to one another and a second set of wires extending substantially parallel to one another, wherein the wires from the first set and the second set intersect, and where these intersect are mutually welded, and wherein the first set of wires are arranged on one side of the wires of the second set. Also the spacing between the wires of each set is larger. Such configuration provides in a less firm panel, but such configuration of wires is less expensive. The square shaped part of each side panel (4) is located underground in the installed state of the fence (1) (see further). Especially the part of the fence (1) which is located aboveground should have a strong and rigid configuration of wires. The part of the fence (1) that is meant to be located underground need not to be that strong and can have a less strong and less expensive configuration of wires. Also the meshes of the part of the fence (1) that is located aboveground should have small meshes to prevent intruders from using these meshes to climb over the fence (1). In FIG. 9 the specific configuration of the wires of a side panel (4) can be viewed.

The configuration of the wires of the bottom panels (3) and rear panels (5) is the same configuration as the configuration of the square shaped parts of the side panels (4). This because the bottom panels (3) and rear panels (5) are located underground in an installed state of the fence (1) and need not to be that strong (see further). The configuration of the wires can clearly be seen in FIG. 9 wherein also a top panel (9) is shown. This top panel (9) has the same configuration as the configuration of the square shaped parts of the side panels (4), because the top panels (9) are also located underground in installed state of the fence (1) (see further).

The fence (1) has two configurations, a compact configuration which is convenient for storage and transportation and also an erected configuration. The erected configuration is the configuration of the fence (1) when it is in its installed state.

The fence (1) comprises in its compact state several equal separate units (6). Each unit (6) comprises a front panel (2), a bottom panel (3), a rear panel (5) and two side panels (4). One unit (6) of the fence (1) has three side panels (4). Each front panel (2) is pivotally connected to the two side panels (4) and pivotally connected to the bottom panel (3). Each bottom panel (3) is pivotally connected to the rear panel (5). These connections are between the edges of the panels (2, 3, 4, 5) except the connection between the front panel (2) and one of the two said side panels (4). One side panel (4) is connected with its edge to the central area of the front panel (2). In the compact state the units (6) are folded up in such a way that the side panels (4) are located between the front panel (2) on the one hand and between the bottom panel (3) and the rear panel (5) on the other hand. Each side panel (4) extends parallel with respect to the front panel (2). The bottom panel (3) and the rear panel (5) extend in the same plane and they are parallel with respect to the side panels (4) and also to the front panel (2). The dimensions of the pivotally connected panels (2, 3, 4, 5) in the direction of their mutual connection are equal. The dimensions of the side panels (4) are situated within the dimensions of the front panel (2) and also the bottom panel (3) and the rear panel (5) who extend in the same plan are situated within the dimensions of the front panel (2). The said pivotal connections are spiral connections (11).

In installed state of the fence (1) each front panel (2) is connected to a bottom panel (3) and three side panels (4). Each rear panel (5) is connected to a bottom panel (3) and is connected to three side panels (4). All these connections are at an angle of 90°. This provides a very strong and solid fence (1). The edge of the side panels (4) which is not connected to the other panels (2, 3, 5) is reinforced with a U-shaped profile (7). This edge corresponds to the hypotenuse of the right-angled triangular shaped part of the side panel (4). With this profile (7), the fence (1) obtains additional rigidity.

The following is a detailed description of the installation of this fence (1). The fence (1) is delivered on site in its compact state. The number of units (6) that is necessary depends on the length of the desired fence (1). The longer the fence (1), the more units (6) are necessary. Each unit (6) is at least 6 meters.

For start, in the ground (10), a ditch (8) is excavated. This can be done with a bulldozer or an excavator. In this ditch (8) the fence (1) will be placed. Before placing the fence (1) in the ditch (8), each unit (6) is unfolded. The unfolding of the unit (6) can be seen in the FIGS. 4 to 6. First the bottom panel (3) is pivoted with respect to the front panel (2). This leaves the side panels (4) being easily accessible. After this the side panels (4) are pivoted with regard to the front panel (2). Then the bottom panel (3) is pivoted with respect to the front panel (2) towards the side panels (4) and the rear panel (5) is pivoted with respect to the bottom panels (3) towards the side panels (4). The bottom panel (3) and the rear panel (5) are connected to the side panels (4) with the aid of spirals (11). After this the separate units (6) are connected to each other with the aid of spirals (11). All units (6) can be connected to each other before placing the fence (1) in the ditch (8) or several units (6) can be connected to each other to create two or more partial fences and these partial fences can then be placed separately in the ditch (8). These partial fences are then connected to each other, after they have been placed in the ditch (8). Even separate units (6) can be placed in the ditch (8). For example for a fence (1) of several kilometers it is not possible to place the entire fence (1) at once in the ditch (8). Partial fences then are placed in the ditch (8).

In an alternative method the side panel (4) of a unit (6) which is connected to the edge of the front panel (2) is separated from the unit (6). During the connection of the different units (6) this side panel (4) is reconnected to the front panels (2) of the units (6) which are connected.

After the connection of the units (6), the fence (1) has several containers. Each container is limited by a bottom panel (3), a front panel (2), side panels (4) and a rear panel (5). These containers provide rigidity and strength to the fence (1).

To place the fence (1) partly underground, the ditch (8) is refilled using the ground (10) that was removed during the excavating of the ditch (8). The ditch (8) is refilled by filling up the space of the ditch (8) surrounding the fence (1) and also by filling the containers. The containers can easily be filled with the aid of an excavator. Preferably the containers are filled before filling up the rest of the ditch (8).

Figures 11A, 11B:
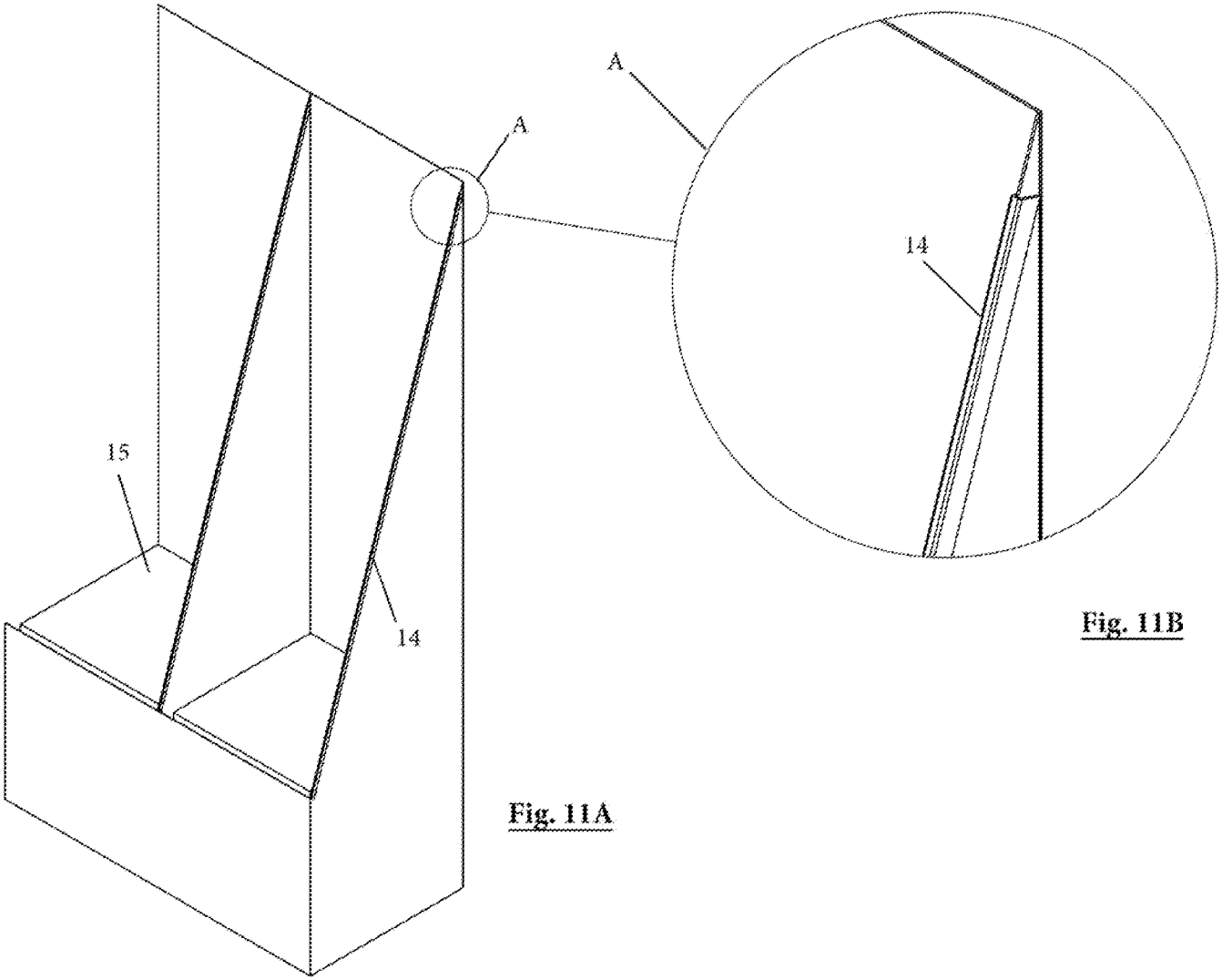
FIG. 11A shows a simplified representation of a perspective view of an embodiment of a fence according to the invention, having a U-shaped profile reinforcing the unconnected edge of the side panel.
FIG. 11B shows a detail view thereof.

Additionally, before filling the containers, bags (15) of geotextile can be placed inside the containers as shown in FIG. 11A. With the aid of these bags (15), the ground (10) that is put inside the containers during the refilling of the ditch (8) will not leave the containers as such simplifying the filling of the containers. Geotextile is also water-permeable, so no water problems will arise later on. Each bag (15) is then preferably connected to the 4 corners of the top side of the container.

Here the bottom panels (3), the rear panels (5), a part of the front panels (2) and the square parts of the side panels (4) are completely located underground.

In the second embodiment, the fence (1) has top panels (9). The top panels (9) are pivotally connected to the rear panels (5) in the compact state of the fence (1). In each folded unit (6), the bottom panels (3), rear panels (5) and top panels (9) extend in the same plane and they lie inside the dimensions of the front panel (2). Two top panels (9) have approximately the same dimension as one bottom panel (3).

During the refilling of the ditch (8), when each container is substantially completely filled, the top panels (9) are pivoted with respect to the rear panels (5) towards the upper side of the containers. These containers are then closed by connecting the top panels (9) to the side panels (4) and the front panels (2) with the aid of spirals (11). After this the top panels (9) are buried until the ditch (8) is completely refilled.

The invention claimed is:

1. A method of installing a fence in which the fence comprises front mesh panels and;

bottom mesh panels;

wherein in an installed state of the fence the front panels are connected at an angle with the bottom panels, in which the method comprises:

placing the fence on the ground, such that the bottom panels are located on the bottom; and burying the bottom panels such that the bottom panels are located underground and such that part of the front panels is located underground and part of the front panels is located aboveground;

wherein in the installed state of the fence the front panels extend substantially in the same plane, and the fence comprises side panels which are, in the installed state of the fence, connected at an angle with the front panels and are connected at an angle with the bottom panels and after the burying of the bottom panels, part of the side panels are located underground and part of the side panels are located aboveground.

2. A method according to claim 1, characterized in that the method comprises, prior to placing the fence, making a ditch, during the placing of the fence, placing the fence in this ditch and, in order to bury the bottom panels, refilling the ditch.

3. A method according to claim 1, characterized in that the fence comprises rear panels which are, in the installed state of the fence, connected with the bottom panels at an angle and are connected with the side panels at an angle and that in the installed state of the fence, the fence comprises containers, confined by the bottom panels, the front panels, the side panels and the rear panels, in which during the burying of the bottom panels, the containers are filled such that they are substantially located underground.

4. A method according to claim 3, characterized in that the fence comprises top panels which in the installed state of the fence delimit the containers, and in which the top panels are placed on top of the containers after the containers are filled up.

5. A method according to claim 4, characterized in that during the burying of the bottom panels, the top panels are also buried.

6. A method according to claim 3, wherein in the installed state of the fence the rear panels are located underground.

7. A method according to claim 6, wherein in the installed state of the fence the height of the rear panels is less than the height of the front panels.

8. A method according to claim 1, characterized in that the front panels are connected at an angle of substantially 90° with the side panels, the front panels are connected at an angle of substantially 90° with the bottom panels and the side panels are connected at an angle of substantially 90° with the bottom panels.

9. A method according to claim 1, characterized in that the fence comprises at least two states, the installed state and a more compact state suitable for transport and storage, wherein the fence is delivered on site in its compact state and wherein the fence is at least partially transformed from its compact state to its installed state before placing the fence on the ground.

10. A method according to claim 9, characterized in that the fence, in its compact state, comprises several separate units which are connected to each other during the transformation from the compact state to the installed state.

11. A method according to claim 10, characterized in that each said separate unit comprises at least one front panel, at least two side panels, at least one bottom panel and at least one rear panel wherein the side panels are pivotally connected to the front panel;

the bottom panel is pivotally connected to the front panel;

the rear panel is pivotally connected to the bottom panel wherein the dimensions of the bottom panel, the side panels and the rear panel extend within the dimensions of the front panel, wherein in the compact state of the fence each separate unit is folded up and that during the transformation of the fence from its compact state to the installed state, each unit is unfolded, the bottom panel is connected at an angle to the side panels, the rear panel is connected to the side panel at an angle and the units are connected to each other.

12. A method according to claim 11, characterized in that in the compact state of the fence each separate unit is folded up such that the side panels are located between the front panel on the one hand and between the bottom panel and the rear panel on the other hand and in which during the unfolding of the units, the bottom panel is pivoted before pivoting a said side panel.

13. A method according to claim 12, characterized in that each said separate unit comprises two top panels which are pivotally connected to the bottom panel, wherein in the compact state of the fence each separate unit is folded up such that the side panels are located between the front panel on the one hand and between the bottom panel, the rear panel and the top panels on the other hand and in which during the transformation of the fence from the compact state to the installed state each top panel is connected to the front panel and to the side panels.

14. A method according to claim 11, characterized in that the bottom panel is connected to the side panels, the rear panel is connected to the side panels and the units are connected to each other with the aid of spirals.

15. A method according to claim 1, characterized in that adjacent panels are connected to each other with the aid of hooks.

16. A method for installing a fence according to claim 1, wherein in an installed state of the fence the bottom panels are connected at an angle with the front panels and the bottom panels and part of the front panels are located underground, and at least the part of the front panels and side panels which are substantially located aboveground comprises a first set of wires extending substantially parallel to one another;

a second set of wires extending substantially parallel to one another, wherein the wires from the first set and the second set intersect, and where these intersect are mutually welded, and wherein a part of the first set of wires is arranged on the other side of the wires of the second set from the rest of the wires of the first set, and with this fence each of the wires of the part of the first set which are arranged on the other side of the second set, viewed in the longitudinal direction of the wires of the second set, are arranged at a certain spacing from the rest of the wires of the first set.

17. A fence comprising front mesh panels and;

bottom mesh panels;

wherein in an installed state of the fence the bottom panels are connected at an angle with the front panels and the bottom panels and part of the front panels are located underground, wherein in the installed state of the fence the front panels extend substantially in the same plane, the fence comprises side panels which, in the installed state of the fence, are connected at an angle with the front panels, are connected at an angle with the bottom panels and are partly located underground, and at least a part of the front panels and side panels which are substantially located aboveground comprise a first set of wires extending substantially parallel to one another;

a second set of wires extending substantially parallel to one another, wherein the wires from the first set and the second set intersect, and where these intersect are mutually welded, and wherein a part of the first set of wires is arranged on the other side of the wires of the second set from the rest of the wires of the first set, and with this fence each of the wires of the part of the first set which are arranged on the other side of the second set, viewed in the longitudinal direction of the wires of the second set, are arranged at a certain spacing from the rest of the wires of the first set.

18. A Pence according to claim 17, characterized in that the wires of the first set are arranged, alternately on both sides of the second set of wires.

19. A fence according to claim 17, characterized in that, the wires from the first set, viewed in the longitudinal direction of the wires from the second set, are arranged at a mutual spacing of between 10 and 15 mm.

20. A fence according to claim 17, characterized in that the fence comprises rear panels and that in the installed state of the fence, the rear panels are connected to the bottom panels and to the side panels such that the fence comprises containers which are delimited by the front panels, the side panels, the bottom panels and the rear panels.

21. A fence according to claim 20, characterized in that each container comprises a bag.

22. A fence according to claim 21, characterized in that the bag is made of a water-permeable material.

23. A fence according to claim 17, characterized in that the part of the front panels and the part of the side panels, which are substantially located underground in the installed state of the fence, comprise a first set of wires extending substantially parallel to one another and a second set of wires extending substantially parallel to one another, wherein the wires from the first set and the second set intersect, and where these intersect are mutually welded, and wherein the first set of wires are arranged on one side of the wires of the second set.

24. A fence according to claim 17, characterized in that side panels are connected by their edges to the other front and bottom panels and that the unconnected edge of the side panel is reinforced with a profile.

25. A fence according to claim 24, characterized in that the profile is a U-shaped profile.

26. A fence comprising front mesh panels and;

bottom mesh panels;

wherein in an installed state of the fence the bottom panels are connected at an angle with the front panels and the bottom panels and part of the front panels are located underground, wherein in the installed state of the fence the front panels extend substantially in the same plane, the fence comprises side panels which, in the installed state of the fence, are connected at an angle with the front panels, are connected at an angle with the bottom panels and are partly located underground, and at least the part of the front panels and side panels which are substantially located aboveground comprise a first set of wires extending substantially parallel to one another;

a second set of wires extending substantially parallel to one another, wherein the wires from the first set and the second set intersect, and where these intersect are mutually welded, and wherein a part of the first set of wires is arranged on the other side of the wires of the second set from the rest of the wires of the first set, and with this fence each of the wires of the part of the first set which are arranged on the other side of the second set, viewed in the longitudinal direction of the wires of the second set, are arranged at a certain spacing from the rest of the wires of the first set, wherein the side panels have a pentagonal shape in which the part of the side panel, which is substantially located aboveground in the installed state of the fence, has a right-angled triangular shape and in which the other part of the side panel, which is substantially located underground in the installed state of the fence, has a rectangular shape.

* * * * *